US008997677B1

(12) United States Patent
Rivoli

(10) Patent No.: US 8,997,677 B1
(45) Date of Patent: Apr. 7, 2015

(54) MINIATURE TORPEDO AND TARGETING CONTROL APPARATUS

(71) Applicant: The Boeing Company, Chicago, IL (US)

(72) Inventor: Louis David Rivoli, Cedar Hill, MO (US)

(73) Assignee: The Boeing Company, Chicago, IL (US)

( * ) Notice: Subject to any disclaimer, the term of this patent is extended or adjusted under 35 U.S.C. 154(b) by 16 days.

(21) Appl. No.: 13/942,994

(22) Filed: Jul. 16, 2013

Related U.S. Application Data

(63) Continuation-in-part of application No. 13/494,243, filed on Jun. 12, 2012, now Pat. No. 8,502,063.

(51) Int. Cl.

| | |
|---|---|
| ***B63G 8/28*** | (2006.01) |
| ***F42B 19/01*** | (2006.01) |
| ***F42B 19/00*** | (2006.01) |

(52) U.S. Cl.
CPC ..... *F42B 19/01* (2013.01); *F42B 19/00* (2013.01)

(58) Field of Classification Search
USPC ..... 89/1.809, 1.81, 5; 114/316, 238, 239
See application file for complete search history.

(56) References Cited

U.S. PATENT DOCUMENTS

| | | | | |
|---|---|---|---|---|
| 4,003,291 | A * | 1/1977 | Vass et al. | 89/1.81 |
| 5,247,887 | A | 9/1993 | Drimmer | |
| 5,786,545 | A * | 7/1998 | Hillenbrand | 114/21.2 |
| 6,376,762 | B1 * | 4/2002 | French et al. | 114/22 |
| 6,494,159 | B2 | 12/2002 | Sirmalis et al. | |
| 7,282,634 | B2 | 10/2007 | Kuklinski | |
| 8,161,899 | B1 * | 4/2012 | Smallin | 114/238 |
| 2004/0065247 | A1 | 4/2004 | Horton | |

* cited by examiner

*Primary Examiner* — J. W Eldred
(74) *Attorney, Agent, or Firm* — Joseph M. Rolnicki; Evans & Dixon, L.L.C.

(57) ABSTRACT

A miniature torpedo has a contact and attachment assembly 106 that is operable to hold the torpedo to a ship, a plurality of flammable elements that are sequentially ignited and burn against the ship's hull, and a propulsion and steering assembly that propels and directs the torpedo to the ship. The torpedo is constructed to be carried by and launched from an unmanned aerial vehicle. A targeting and control apparatus is employed with the torpedo that provides wire guidance to the torpedo and an ability to communication with other aparatus to coordinate an attack with multiple torpedos.

19 Claims, 18 Drawing Sheets

MINIATURE TORPEDO AND TARGETING CONTROL APPARATUS

This patent application is a continuation-in-part of application Ser. No. 13/494,243 which was filed on Jun. 12, 2012 and issued as U.S. Pat. No. 8,502,063 on Aug. 6, 2013.

FIELD

The present invention relates to a miniature torpedo and more particularly, to a lightweight, miniature torpedo that can be carried by and launched from an unmanned aerial vehicle and a targeting control apparatus employed with the torpedo.

BACKGROUND

Typical anti-ship torpedos are too heavy and too large to be carried by and launched from an unmanned aerial vehicle (UAV). A typical torpedo is constructed using heavy plastique explosives. The amount and type of explosives employed in a typical torpedo add significantly to the torpedo's size and weight. As typical, small UAVs have a limited payload capacity, the size and weight of typical, larger torpedoes prohibit their use on smaller scale UAV platforms.

SUMMARY

The miniature torpedo of the present invention overcomes the size and weight disadvantages of conventional torpedoes that prevent them from being carried by and launched from smaller UAVs in addition to significantly increasing the torpedo payload capability of both larger UAVs and conventional manned anti-ship aircraft, and anti sub-surface ship aircraft. The miniature torpedo of the invention has an overall length of approximately 18.5 inches and approximate weight of less than 10 pounds. The miniature torpedo is therefore ideally suited for being carried by and launched from small UAVs while also increasing the torpedo carrying capacity of larger UAVs and conventional manned aircraft.

The miniature torpedo of the invention is basically comprised of a contact and attachment assembly, a chamber containing at least one or more flammable element(s), and an ignition assembly for example magnesium or a magnesium alloy.

The contact and attachment assembly attaches the torpedo to a ship's hull.

One or more flammable element(s) are moveable by a drive mechanism through the chamber and toward the ship's hull.

The ignition assembly ignites one or more flammable element(s) and releases the ignited element(s) from the chamber.

The drive mechanism positions the ignited element against the ship's hull where the high temperature heat of the burning element(s) melt a hole through the ship's hull.

The miniature torpedo also includes a propulsion and steering assembly that is operable to propel and steer the torpedo through water below the water line.

The miniature torpedo also includes a navigation and guidance assembly that controls the propulsion and steering assembly to direct the torpedo through the water toward the ship's hull.

The apparatus also includes a targeting sensor and guidance transducer assembly that intercepts information on a location of the ship's hull and communicates the information to the navigation and guidance assembly. The navigation and guidance assembly uses the communicated information to control the propulsion and steering assembly to direct the miniature torpedo through the water to the ship's hull.

In a further embodiment the miniature torpedo is modified with a targeting control apparatus that floats on the water surface and releasably suspends the miniature torpedo under water.

BRIEF DESCRIPTION OF THE DRAWINGS

Further features of the invention are set forth in the following description of the invention and in the drawing figures.

DESCRIPTION

Figure 1:
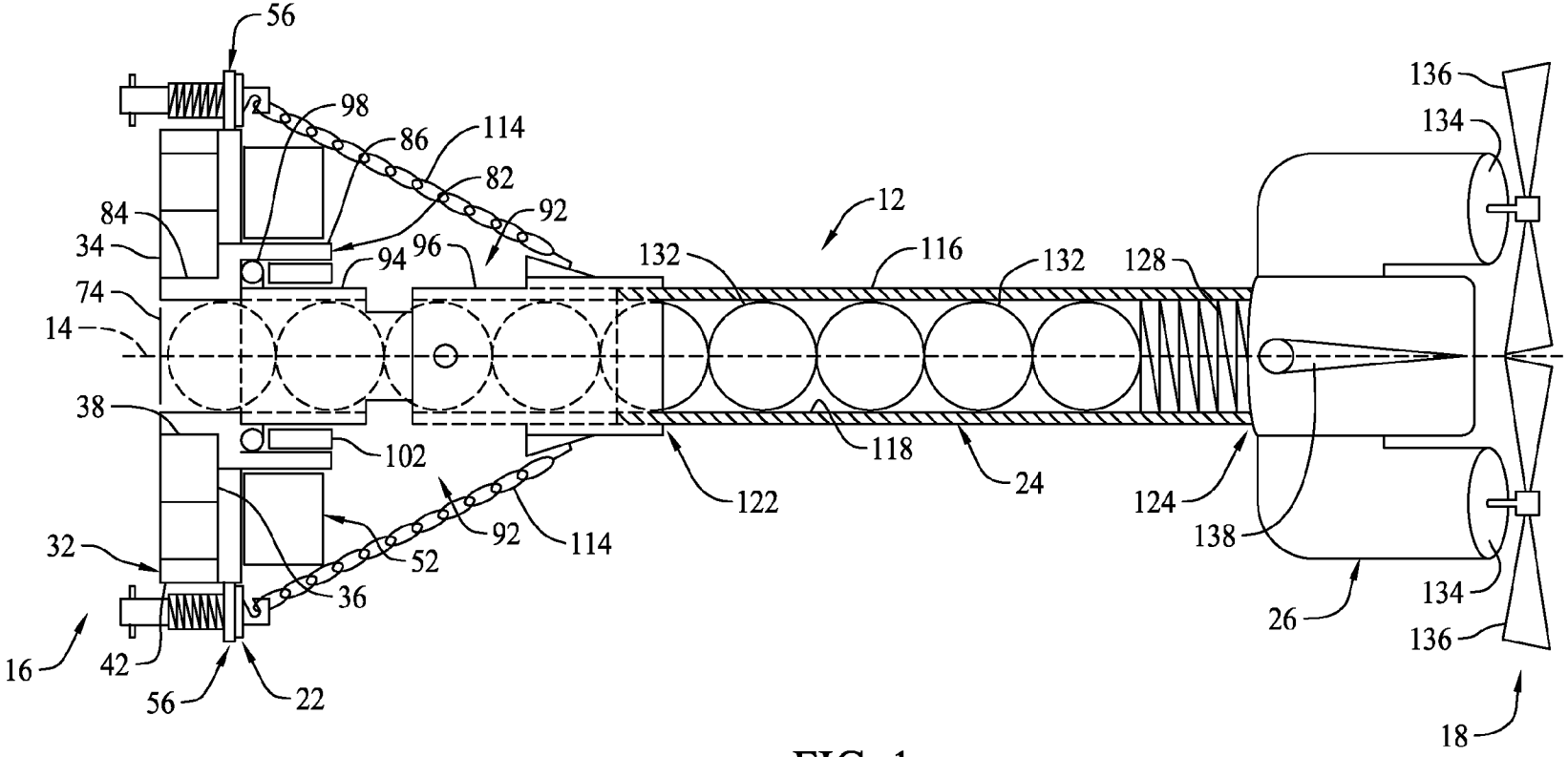
FIG. 1 is an illustration of a side view of the apparatus of the invention.
Figure 2:
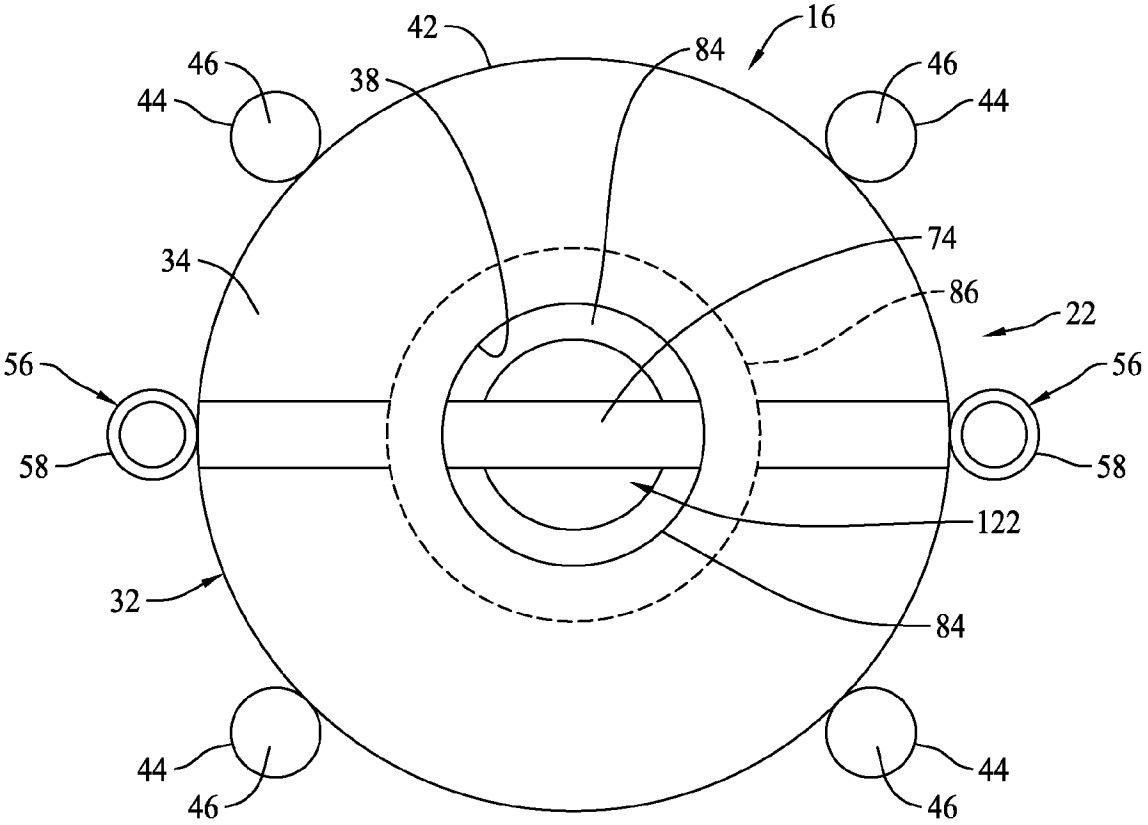
FIG. 2 is a front view illustration of the contact and attachment assembly of the apparatus taken from the left side of the apparatus shown in FIG. 1.
Figure 3:
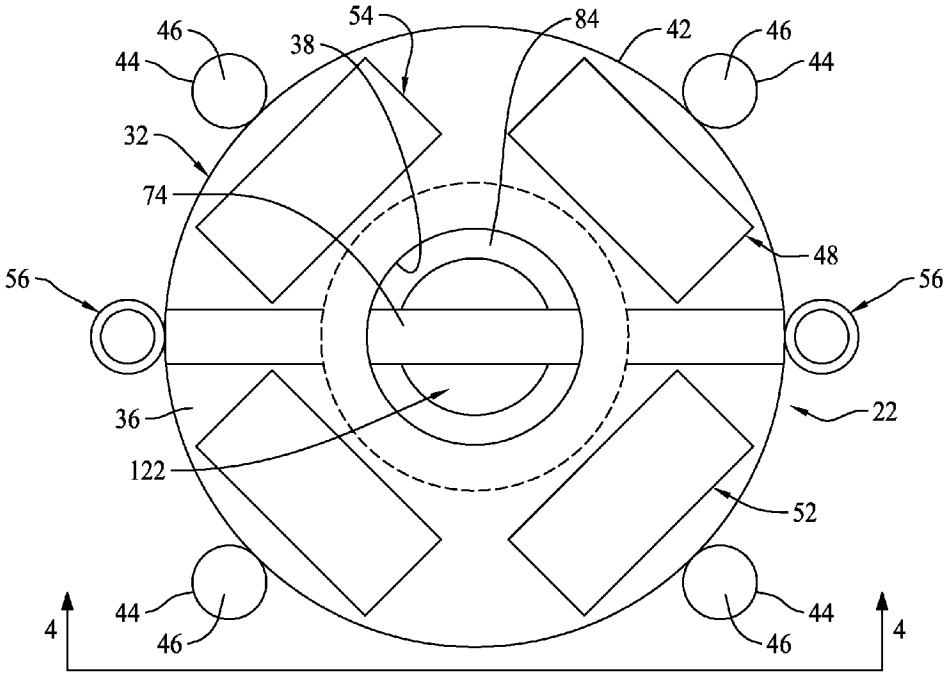
FIG. 3 is a rear view illustration of the contact and attachment assembly shown in FIG. 2.
Figure 4:
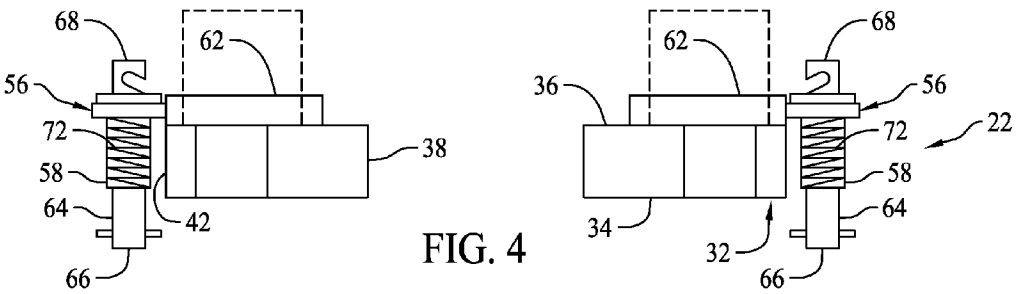
FIG. 4 is a side view illustration of the contact and attachment assembly along the line 4-4 shown in FIG. 3.

FIG. 1 is an illustration of a side view of the miniature torpedo apparatus of the invention 12 showing some of the parts in partial cross-section. The construction of the apparatus 12 to be described is, for the most part, symmetrical around a center axis 14 of the apparatus. The apparatus 12 has an overall axial length from a forward end 16 to a rearward end 18 of the apparatus of approximately 18.5 inches. The component parts of the apparatus 12 are constructed of materials that provide the apparatus 12 with sufficient structural strength for its intended purpose and with the apparatus having an approximate weight of less than 10 pounds. Component parts constructed of specific materials will be identified.

The miniature torpedo 12 is basically comprised of a contact and attachment assembly 22 at the forward end 16 of the apparatus, a chamber 24 operatively connected to the contact and attachment assembly 22 and extending reanNardly thereof, and a propulsion and steering assembly 26 operatively connected to the chamber 24 at the rearward end 18 of the apparatus.

Referring to FIGS. 1-4, a major component part of the contact and attachment assembly 22 is an annular permanent magnet assembly 32. The magnet assembly 32 comprises one or more substantially flat permanent magnets, annular forward surface 34 and an opposite, substantially flat, annular rearward surface 36. The magnet assembly surface 34 has a cylindrical interior surface 38 surrounding a center bore through the magnet assembly 32 and a cylindrical exterior surface 42. The two cylindrical surfaces 38, 42 extend axially between the magnet assembly 32 forward 34 and rearward 36 surfaces. The magnet assembly forward surface 34 is positioned to attach the miniature torpedo 12 to the hull of a ship when the surface makes contact with the hull. The flux field of the magnet assembly surface 34 in addition to the 90 degree, rotational flexibility of the hollow universal joint or u-joint assembly 92, has a sufficient adherence and conformal hydrodynamics to hold the apparatus 12 to a ship's hull even when the ship is underway through water.

Four or more guidance transducer assemblies 44 are secured to the magnet exterior surface 42 at equal circumferentially spaced positions. The transducer assemblies 44 are positioned or oriented parallel with the apparatus center axis 14. Sonic signal receiving surfaces 46 of the assemblies 44 face forwardly of the apparatus. The guidance transducer assemblies 44 function as target sensors.

A sonic navigation guidance assembly 48 is secured to the magnet assembly's rearward surface 36. The sonic navigation guidance assembly 48 communicates with and receives signals from the guidance transducer assemblies 44.

A control system 52, for example, a central processing unit (CPU) 52 is secured to the magnet assembly rearward surface 36. The CPU communicates with the guidance transducer assemblies 44 and the sonic navigation guidance assembly 48 and controls the operations of these assemblies. The CPU also communicates with the propulsion and steering assembly 26 and controls the operation of this assembly.

A power source 54 is also secured to the magnet rearward surface 36, and, or alongside chamber 24. The power source 54 is comprised of one or more batteries and communicates with the guidance transducer assemblies 44, the sonic navigation guidance assembly 48, the CPU 52 and the propulsion and steering assembly 26 and provides power to all these components.

A pair of tethers 114 connects to contact release mechanisms 56, and are secured to the magnet assembly 32 at diametrically opposite sides of the magnet assembly exterior surface 42. Each mechanism 56 has a cylindrical housing 58 that is connected to a base 62. Each base 62 is secured to the magnet assembly's rearward surface 36. The cylindrical housings 58 are positioned at diametrically opposite sides of the magnet assembly's exterior surface 42 with center axes of the cylindrical housings being aligned parallel with the apparatus center axis 14. A plunger 64 is mounted in each cylindrical housing 58 for axial reciprocating movements forwardly and rearwardly through the housing. Each plunger 64 has a forward contact end 66 and an axially opposite hook end 68. Springs 72 in the cylindrical housings 54 bias the plungers 64 forwardly to their positions shown in FIGS. 1 and 4.

A retention and ignition assembly 74 is secured to the magnet assembly 32 at the center of the magnet forward surface 34. The retention and ignition assembly 74 is formed as a flat strip that extends radially across the magnet assembly center bore and then axially across opposite sides of the magnet assembly's cylindrical interior surface 38. The strip 74 is constructed of a material that will ignite and burn when supplied with an electric current, for example magnesium or a magnesium alloy. The strip 74 is connected in communication with the power source 52 through the CPU 54 and its ignition is controlled by the CPU.

Figure 5:
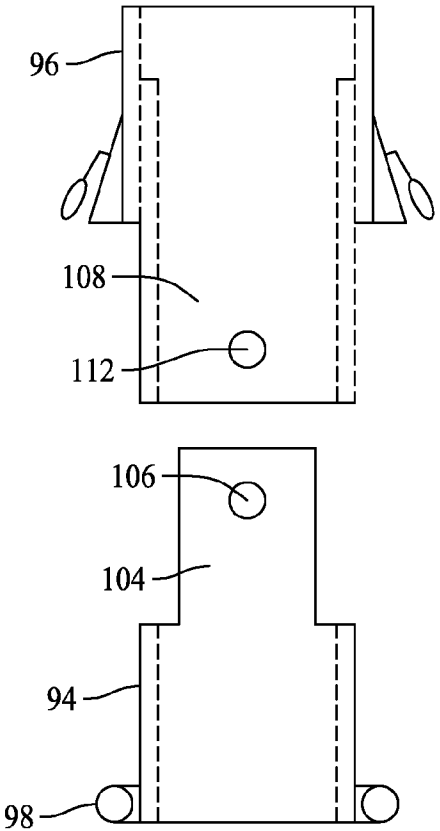
FIG. 5 is an illustration of the component parts of the hollow universal joint disassembled

A cylindrical housing 82 extends into the magnet assembly's center bore and is secured to the magnet assembly interior surface 38 and to a portion of the magnet rearward surface 36. The cylindrical housing 82 is shown in FIGS. 1 and 5. The cylindrical housing 82 has a smaller cylindrical portion 84 that is fit into and secured to the cylindrical interior surface 38 of the magnet assembly 32. A larger cylindrical portion 86 of the housing 82 is secured to the magnet assembly rearward surface 36 and projects rearwardly as it intersects retaining ring 102. The cylindrical housing 82 is constructed of a high heat resistant material, for example a ceramic material.

Figure 6:
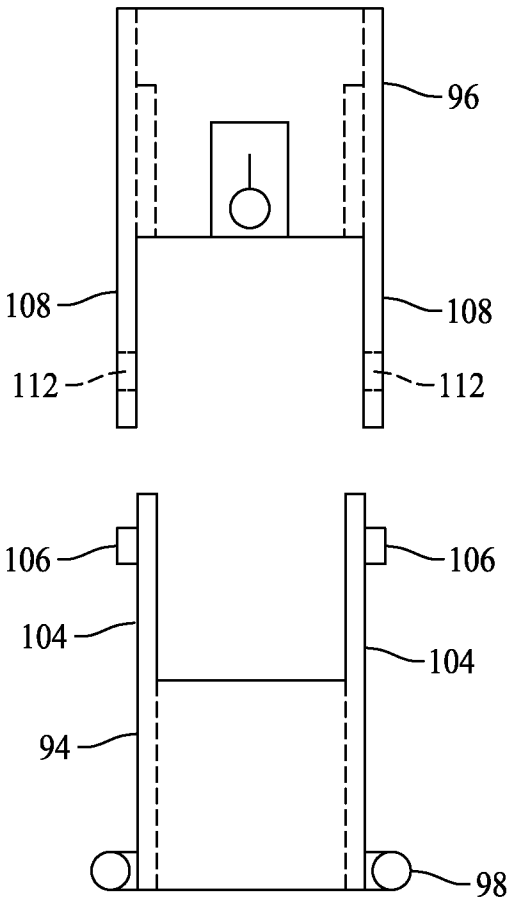
FIG. 6 is an illustration of the component parts of the hollow universal joint disassembled and rotated 90 degrees from their positions shown in FIG. 5.
Figure 7:
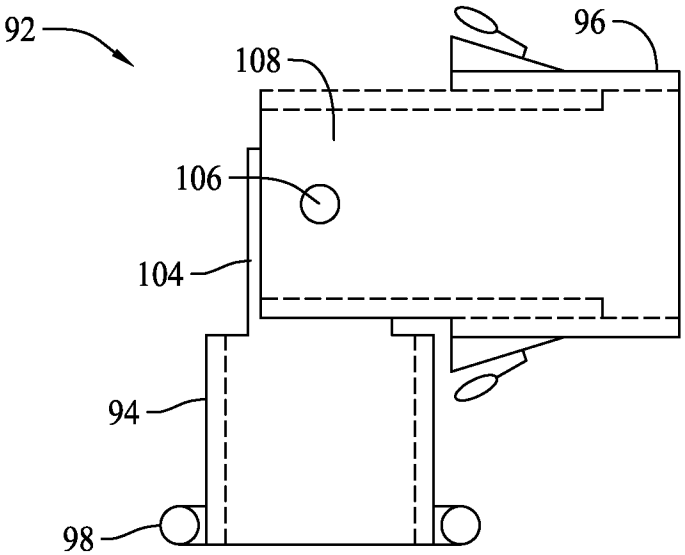
FIG. 7 is an illustration of the hollow universal joint component of the contact and attachment assembly removed from the assembly.
Figure 8:
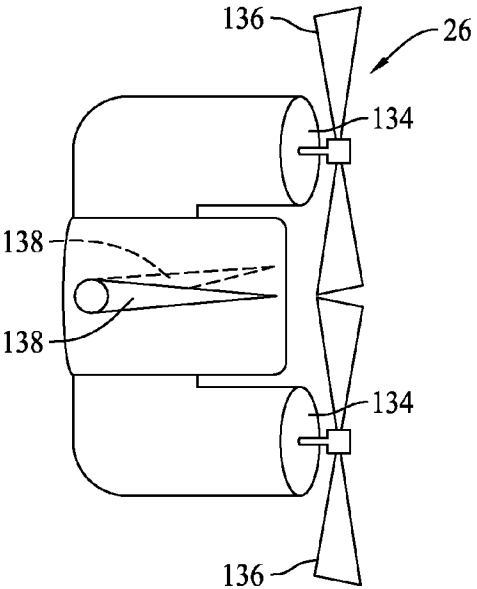
FIG. 8 is an illustration of the propulsion and steering assembly of the apparatus.
Figure 8A:
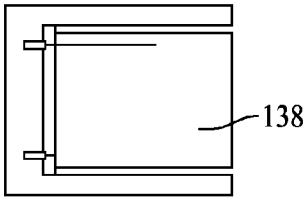
FIG. 8*a* is a side view illustration of a steering assembly fairing having a pivoting rudder removed from the propulsion and steering assembly of FIG. 8.
Figure 9:
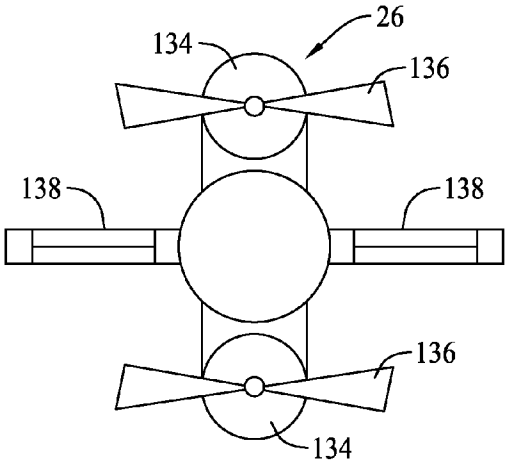
FIG. 9 is a rear view illustration of the propulsion and steering assembly taken from the right side of the assembly shown in FIG. 8.
Figure 10:
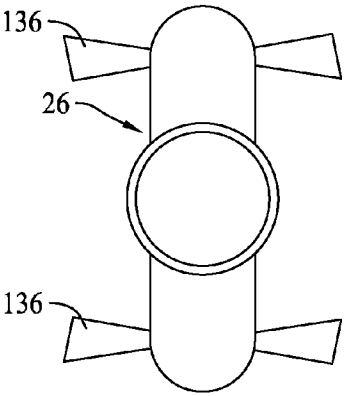
FIG. 10 is a front view illustration of the propulsion and steering assembly taken from the left side of the assembly as shown in FIG. 8.

A hollow universal joint or hollow u-joint assembly 92 is secured inside the large portion 86 of the cylindrical housing 82. The hollow u-joint assembly 92 is comprised of a cylindrical forward portion 94 and a cylindrical rearward portion 96. The joint forward portion 94 has a bearing ring 98 secured to its exterior surface. The bearing ring 98 interfaces the interior surface of the large portion 86 of the cylindrical housing 82, thereby operatively connecting the hollow u-joint assembly 92 to the contact and attachment assembly 22. A retaining ring 102 is press-fit into the large portion 86 of the cylindrical housing 82 to secure the hollow u-joint forward portion 94 to the housing 82. The bearing ring 98 allows the hollow u-joint assembly 92 to rotate freely about the apparatus center axis 14 relative to the contact and attachment assembly 22. The retaining ring 102 prevents the u-joint assembly 92 from moving axially relative to the contact and attachment assembly 22. Referring to FIGS. 5, 6 and 7, the hollow u-joint assembly forward portion 94 has a pair of rearwardly projecting flanges 104 on diametrically opposite sides of the forward portion. Each of the flanges 104 has a pivot post 106 projecting radially outwardly from the flange. The hollow u-joint assembly rearward portion 96 also has a pair of flanges 108 that project forwardly on diametrically opposite sides of the rearward portion 96. Each of these flanges 108 has a pivot post hole 112. As seen in FIG. 5, the pivot post 106 of the u-joint forward portion 94 engage in the pivot post holes 112 of the u-joint rearward portion 96 forming a pivoting connection between the two portions that allows the two portions to pivot to a 90 degree angle.

Together, the bearing ring 98 and the joint assembly between the joint forward portion 94 and the joint rearward portion 96 form a hollow universal joint between the contact and attachment assembly 22 and the joint rearward portion 96 that enables the joint rearward portion 96 to rotate freely around the center axis 14 of the apparatus 12 and allows the joint rearward portion 96 to move through a 180 degree arc relative to the contact and attachment assembly 22.

A pair of tethers 114 are secured to diametrically opposite sides of the joint assembly rearward portion 96. The tethers 114 are shown in the drawing figures as small link chains. However, other equivalent flexible cords could be substituted for the link chains. The tethers extend from the joint assembly rearward portion 96 to the plunger hook ends 68 of the harness contact release mechanisms 56. The springs 72 of the harness contact release mechanisms 56 pull the tethers 114 tight as they extend between the harness contact release mechanisms 56 and the joint assembly rearward portion 96. In this manner, the tethers 114 hold the joint rearward hollow u-joint assembly 96 in a position relative to the contact and attachment assembly 22 shown in FIG. 1 and prevent the hollow u-joint assembly rearward portion 96 from pivoting relative to the contact and attachment assembly.

The tubular chamber 24 is operatively connected between the contact and attachment assembly 22 and the propulsion and steering assembly 26. The chamber 24 has a cylindrical exterior surface 116 and a cylindrical interior surface 118. The chamber 24 has a straight length that extends forward 122 between rearward u-joint assembly 96 and axially opposite rearward end 124 of the chamber. The chamber forward end 122 is open and extends into the joint assembly rearward portion 96 and is secured thereto, thereby operatively connecting the chamber 24 to the contact and attachment assembly 22. The chamber rearward end 124 is closed and is secured to the propulsion and steering assembly 26. The chamber 24 has an interior diameter dimension that is substantially the same as that of the joint assembly rearward portion 96, the hollow u-joint assembly forward portion 94 and the small portion 86 of the cylindrical housing 82. Thus, there is a continuous interior bore that extends through the chamber 24 from the chamber rearward end 124, through the joint assembly 92 and through the permanent magnet assembly 32.

A spring drive mechanism 128 is positioned in the chamber 24 at the chamber rearward end 124. The spring drive mechanism 128 is illustrated in the drawing figures as a coil spring. Other equivalent spring drive mechanisms could be employed instead of the coil spring. The spring drive mechanism 128 is shown in a compressed condition in FIG. 1. In its uncompressed condition the spring drive mechanism 128 extends completely through the continuous interior bore defined through the chamber 24, the hollow u-joint assembly 92 and the magnet assembly 32.

A plurality of flammable elements 132 are contained in the chamber 24, the hollow u-joint assembly 92 and the cylindrical housing 82. Adjacent flammable elements 132 are linked together, for example by a short cord (not shown). The spring drive mechanism 128 urges the flammable elements 132 toward the forward end 16 of the miniature torpedo apparatus 12 where a forward end of the elements 132 engages against and is retained by the retention and ignition assembly 74. Each of the flammable elements 132 has a spherical configuration that can be driven and moved easily through the chamber 24, the hollow u-joint assembly 92 and the cylindrical housing 82 by the spring drive mechanism 128. Each of the elements 132 is constructed of a flammable material such as magnesium or a magnesium alloy that can be easily ignited and will oxidize when ignited and burn at a combustion temperature that is sufficiently high to melt through a metal ship's hull.

The propulsion and steering assembly 26 is operable to drive the apparatus 12 through water to a targeted ship's hull. The assembly 26 is connected in communication with the CPU 52 and operates in response to signals received from the CPU. The assembly 26 includes a pair of electric motors 134 that each drive propellers 136 in rotation. The assembly 26 also includes a pair of pivoting rudders 138 that steer the apparatus 12 through the water in response to signals received from the CPU 52.

Figures 11, 12:
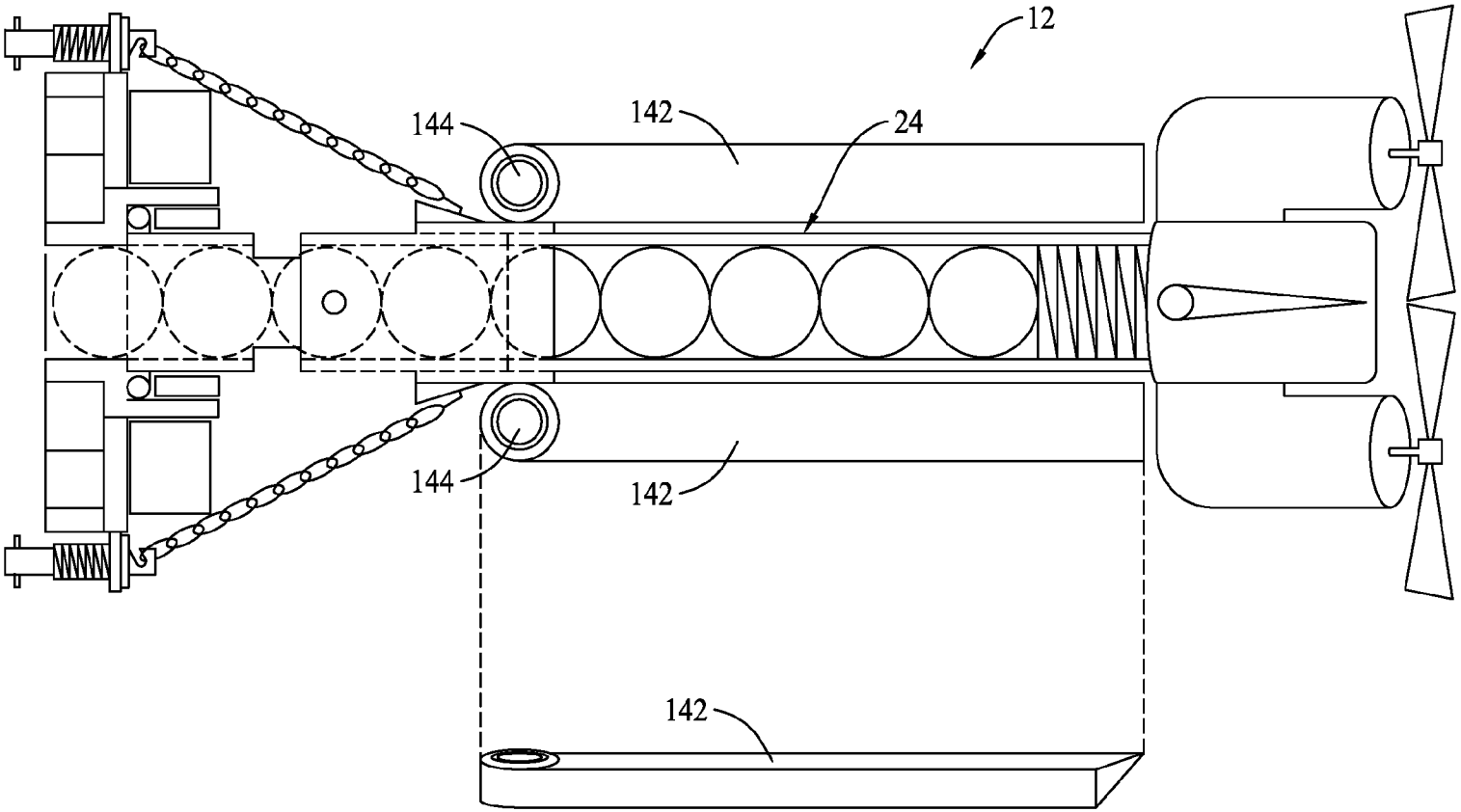
FIG. 11 is an illustration of an alternate embodiment of the torpedo apparatus that employs extended range fairings.
FIG. 12 is an illustration of a fairing of the apparatus shown in FIG. 11 removed from the apparatus.
Figure 13:
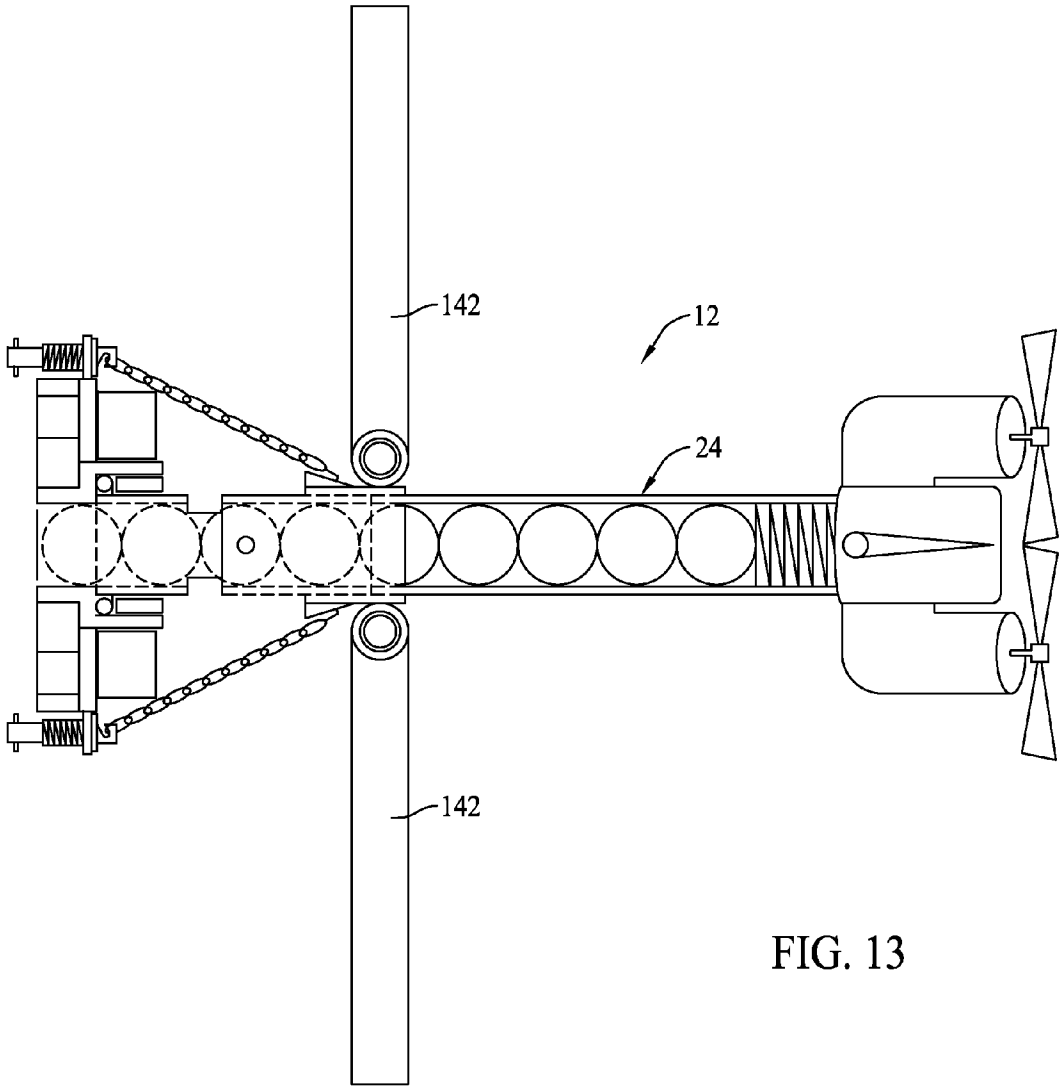
FIG. 13 is an illustration of the apparatus shown in FIG. 11 with the extended range fairings deployed.

FIGS. 11-13 show an alternative embodiment of the apparatus in which a pair of extended range fairings 142 have been added to the apparatus. The fairings 142 are attached to diametrically opposite sides of the chamber 24 by pivoting connections 144. As shown in FIG. 11, the fairings 142 are initially positioned extending along the opposite sides of the chamber 24 when the apparatus is carried by a UAV and launched by the UAV. Once in the water and below the water level, the fairings 142 are deployed to their positions shown in FIG. 13 where the fairings can increase the range of the miniature torpedo apparatus 12 as it travels through water.

Figure 14:
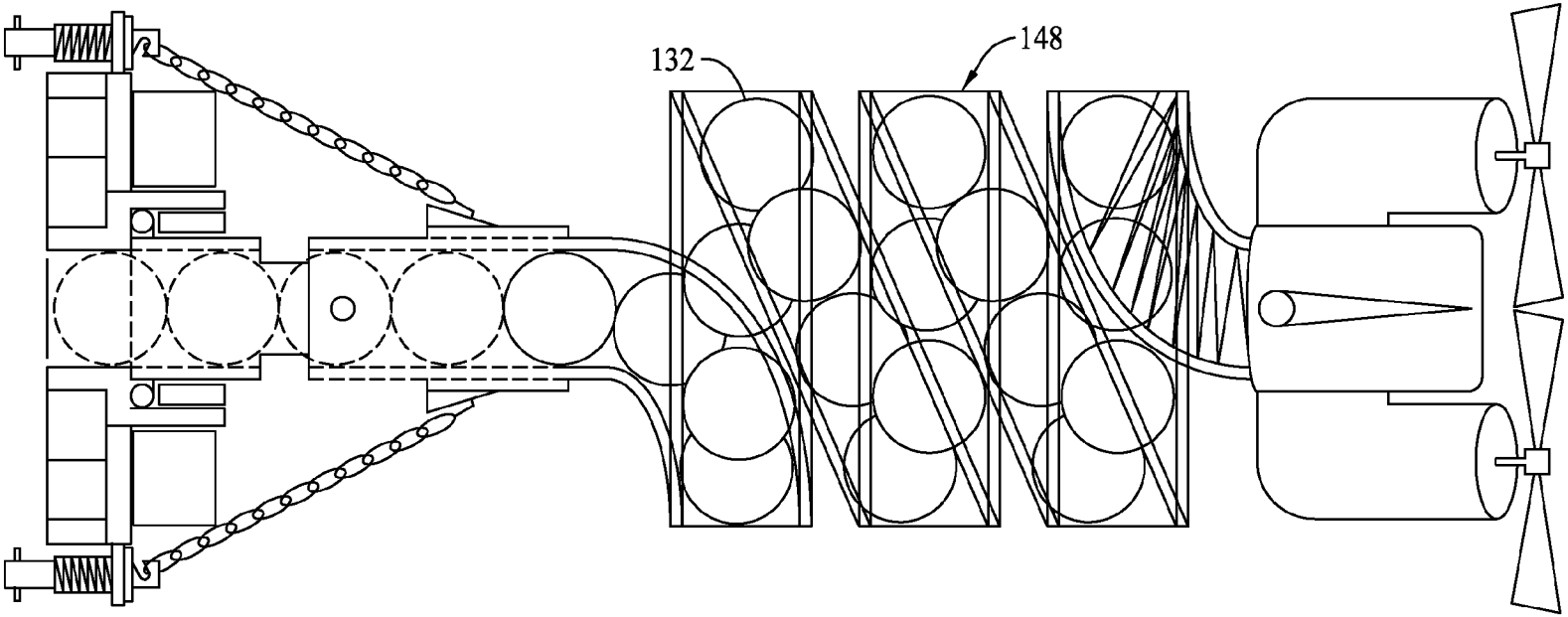
FIG. 14 is an additional illustration of an alternate embodiment of the miniature torpedo apparatus that utilizes a high capacity helical housing for containment of a larger volume of flammable element(s). The helical housing embodiment provides for increased lethality of the miniature torpedo.

An additional alternate embodiment of the apparatus is shown in FIG. 14. In this embodiment, the straight tubular chamber 24 is replaced with a helical tubular chamber 148. The helical tubular chamber 148 increases the number of flammable elements 132 that can be carried by the apparatus. The operation of the embodiment shown in FIG. 14 is substantially the same as that of the embodiment shown in FIG. 1 to be described.

The apparatus 12 is designed to be carried by a UAV to the general geographic area of a ship detected by a remote acoustic sensor. The apparatus 12 is designed to be effective against both surface ships and sub-surface ships. Following detection of the ship by the remote acoustic sensor, a UAV carrying the apparatus 12 will launch or deploy the apparatus 12 in the general geographic area of the detected ship. A small parachute attached to the apparatus 12 will allow it to slowly fall from the UAV to the water surface. Once in the water, the CPU 52 will control the apparatus 12 to release the parachute, target the ship hull with the guidance transducer assemblies 44 and travel to the targeted hull using the sonic navigation guidance assembly 48 and the propulsion and steering assembly 26.

When the targeted ship hull is reached, the apparatus 12 will attach to the metal of the ship hull by the permanent magnet assembly 32. Attachment of the magnet assembly 32 to the ship hull depresses the plungers 64 of the harness contact release mechanism 56 causing the tethers 114 to disengage from the plunger hook ends 68 and freeing the hollow u-joint assembly rearward portion 96 to rotate and pivot relative to the contact and attachment assembly 22. This allows the chamber 24 of the apparatus to rotate around the apparatus center axis 14 and pivot up to 90 degrees to conform the chamber 24 to the hydrodynamic forces of a moving ship hull. The releasing of the harness contact release mechanism 56 also causes the CPU 52 to concurrently trigger the electrical ignition of the retention and ignition assembly 74. This in turn ignites and releases the forward most of the flammable elements 132 to be moved forwardly by the drive mechanism 128 and engage against the ship hull. Once ignited, the combustion temperature of the flammable element 132 will cause the area of the ship's hull engaged by the element to melt and will bore through the hull of the targeted ship. As the combustion of one flammable element 132 is completed it ignites the next in line flammable element which is then pressed against the melting area of the ship hull by the drive mechanism 128. This continues until the burning flammable elements 132 bore a hole through the ship hull.

Figure 15:
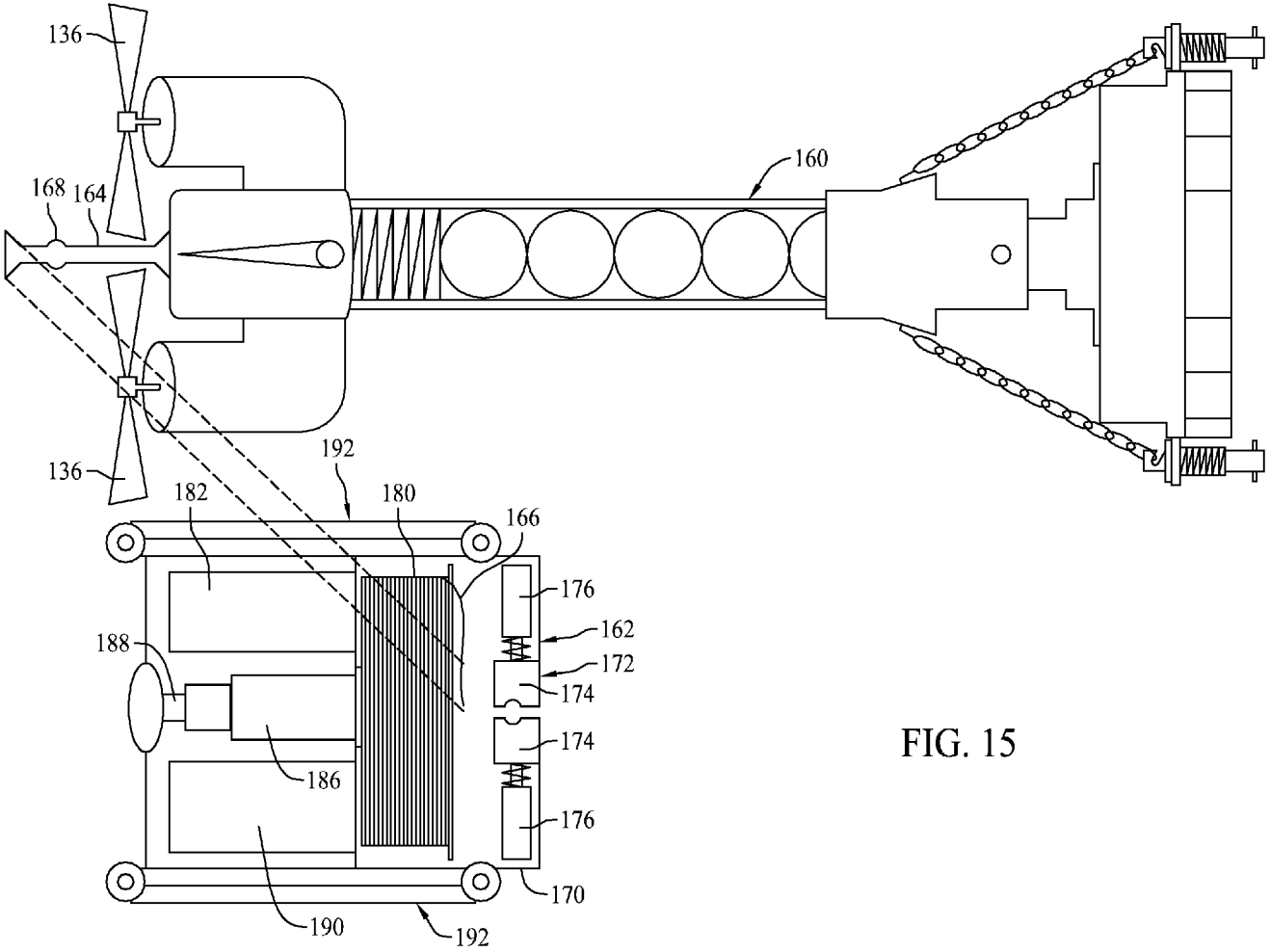
FIG. 15 is an illustration of a side view of a further embodiment of the miniature torpedo apparatus that includes a targeting control apparatus.

FIG. 15 is a representation of a further embodiment of the miniature torpedo 160 employed with a targeting control apparatus 162. The miniature torpedo 160 has basically the same construction as the earlier described embodiment of the miniature torpedo 12 except for the addition of a rigid tubular sleeve 164 that projects from the rearward end of the torpedo 160 and one or more lengths of electrically conductive wiring 166, for example guidance wiring, that extend through the tubular sleeve 164 to the targeting control apparatus 162.

The tubular sleeve 164 projects straight from the rearward end of the miniature torpedo 160 between the pair of propeller blades 136. The sleeve 164 has a length that extends just beyond the propeller blades 136. In this manner, the sleeve 164 protects the wiring 166 from the propeller blades 136 and prevents the wiring from becoming tangled in the propeller blades. The sleeve 164 also has an exterior protrusion 168 that extends around the sleeve. The protrusion 168 is positioned beyond the propeller blades 136 by the length of the sleeve. The protrusion 168 is employed in releasably attaching the miniature torpedo 160 to the targeting control apparatus 162.

The targeting control apparatus 162 contains electronic components that communicate with the miniature torpedo 160 through the wiring 166. The electronic components provide information to the torpedo that enables the torpedo to communicate with applicable sea, air, land or space based Command and Control platforms and/or other torpedoes in the area that also have a targeting control apparatus. The targeting control apparatus 162 thereby provides the miniature torpedo 160 with the ability to improve and coordinate its target detection, target acquisition and target lethality.

The targeting control apparatus 162 includes a generally cylindrical sealed housing 170 that contains the electronic components of the apparatus. There is an opening in the center of the bottom of the housing 170. The opening is dimensioned to receive the distal end of the tubular sleeve 164.

Inside the housing 170 and adjacent the bottom opening is a catch mechanism 172. The catch mechanism 172 has a pair of clamps 174 that are configured to engage around the protrusion 168 on the torpedo sleeve 164. In this manner the catch mechanism 172 releasably attaches the torpedo 160 to the targeting control apparatus 162.

Figure 16:
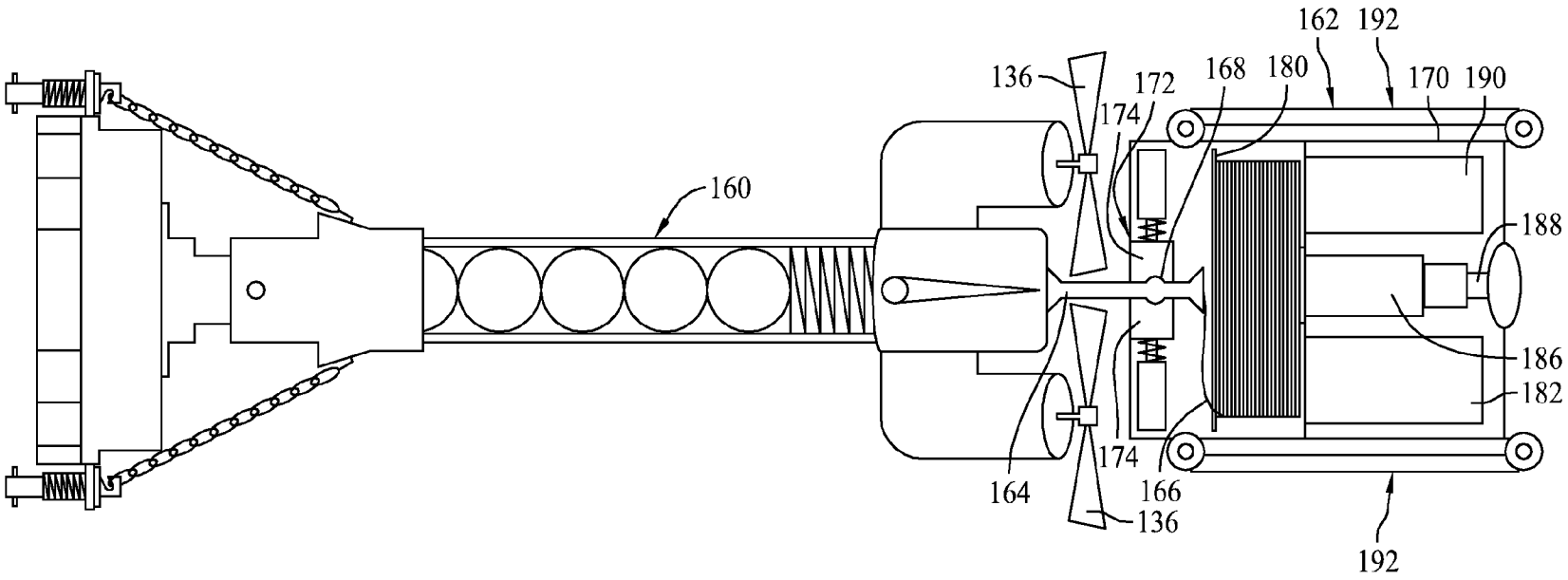
FIG. 16 is an illustration of a side view of the miniature torpedo releasably attached to the targeting control apparatus.

In the representation shown in FIGS. 15 and 16, the catch mechanism clamps 174 are shown powered by spring biased solenoid assemblies 176. The torpedo 160 is shown releasably attached to the targeting control apparatus 162 in FIG. 16. Springs 178 of the solenoid assemblies push the catch mechanism clamps 174 toward each other and around the tubular sleeve protrusion 168 in releasably attaching the miniature torpedo 160 to the targeting control apparatus 162. When the solenoids 176 are activated they pull the pair of catch mechanism clamps 174 away from each other and thereby release the miniature torpedo 160 from the targeting control apparatus 162.

A cylindrical spool 180 is also provided in the housing 170. The wiring 166 is wrapped around the spool 180 and extends from the interior of the housing 170 through the hole in the bottom of the housing provided for the torpedo tubular sleeve 164. A first end of the wiring 166 is operatively connected in electrical communication with a control unit 182 in the housing interior. An opposite, second end of the wiring 166 extends through the tubular sleeve 164 of the torpedo 160 and is operatively connected in electrical communication with the electronic components of the torpedo that control the functioning of the torpedo.

The control unit 182 controls the functioning of the targeting control apparatus 162 and the torpedo 160 in response to control signals received by the control unit.

A communication device 186 is also contained in the housing 170. The communication device 186 is operatively connected in electronic communication with the control unit 182. The communication device 186 includes a tranceiver and an telescoping antenna 188 or other similar equivalent equipment. The communication device 186 is operable to send communication signals through the antenna 188 to antennas of other targeting control apparatus and is able to receive communication signals from the other targeting control apparatus through the antenna. The communication device 186 is also operable to communicate a release signal to the control unit 182 in response to the communication device receiving a control signal transmitted from a separate source. The release signal communicated to the control unit activates the control unit to control the catch mechanism 172 to detach from the miniature torpedo 160 and release the torpedo 160 from the targeting control apparatus 162.

In addition to the above described electronic components housed in the housing 170, the targeting control apparatus is provided with a power source 190, such as one or more batteries and/or solar panels or other equivalent equipment. The power source 190 supplies power to the electronic components of the targeting control apparatus 162 and also supplies power to the torpedo 160 through the wiring 166.

Figure 17:
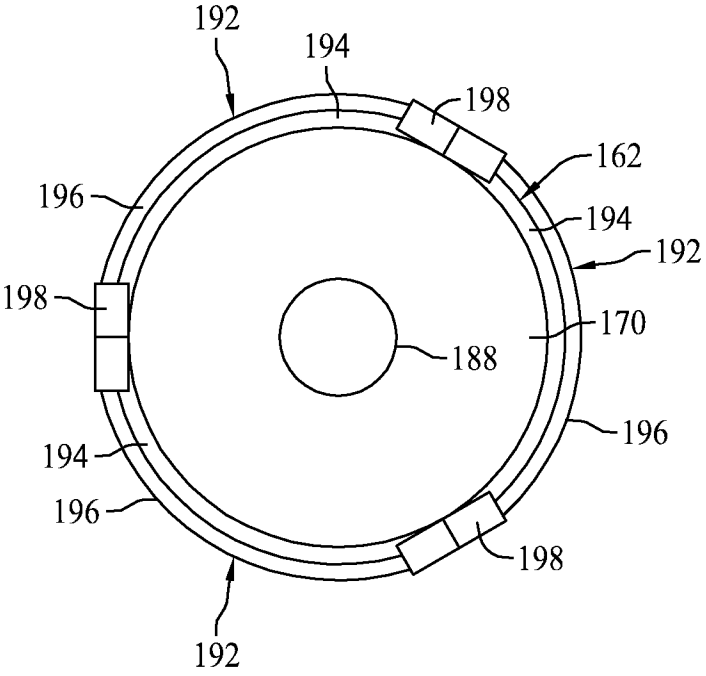
FIG. 17 is an illustration of a top plan view of the targeting control apparatus.
Figure 18:
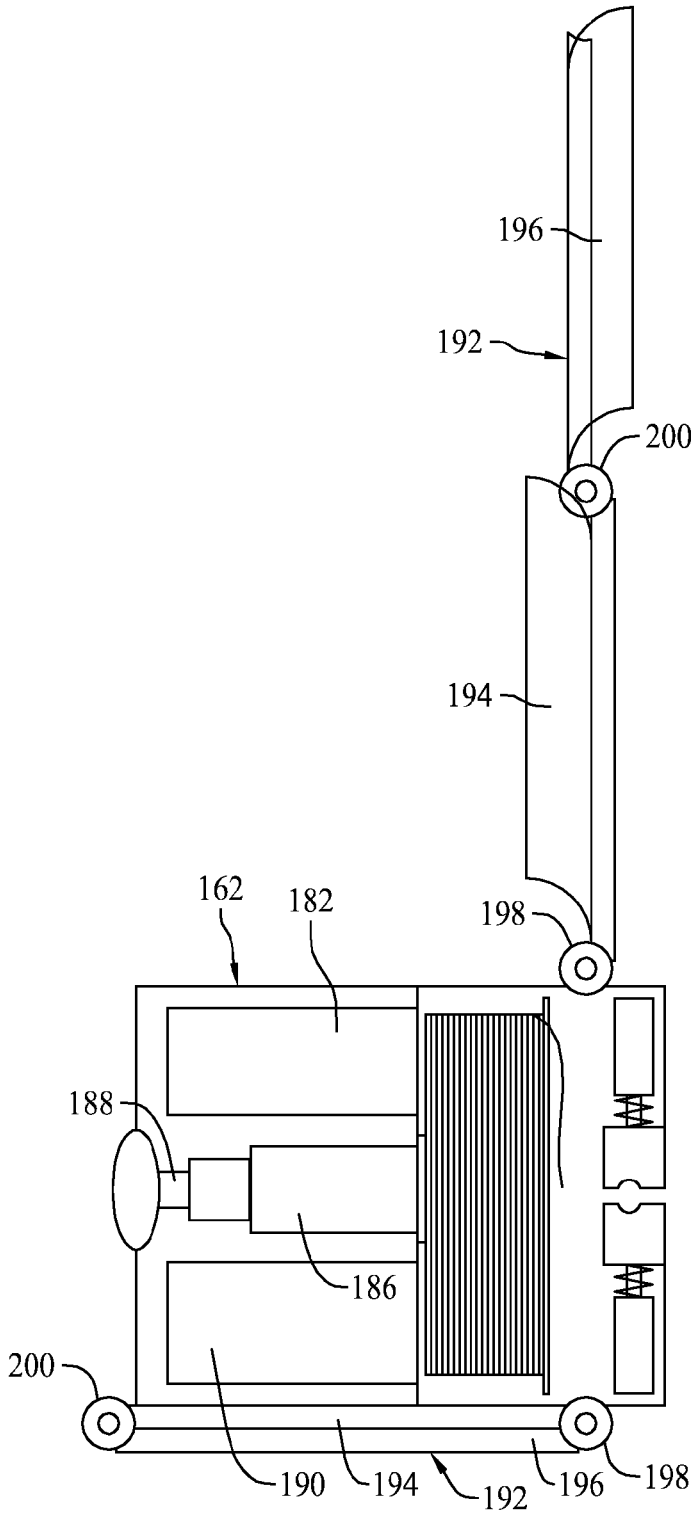
FIG. 18 is an illustration of a side view of the targeting control apparatus with a flotation device partially deployed.
Figure 19:
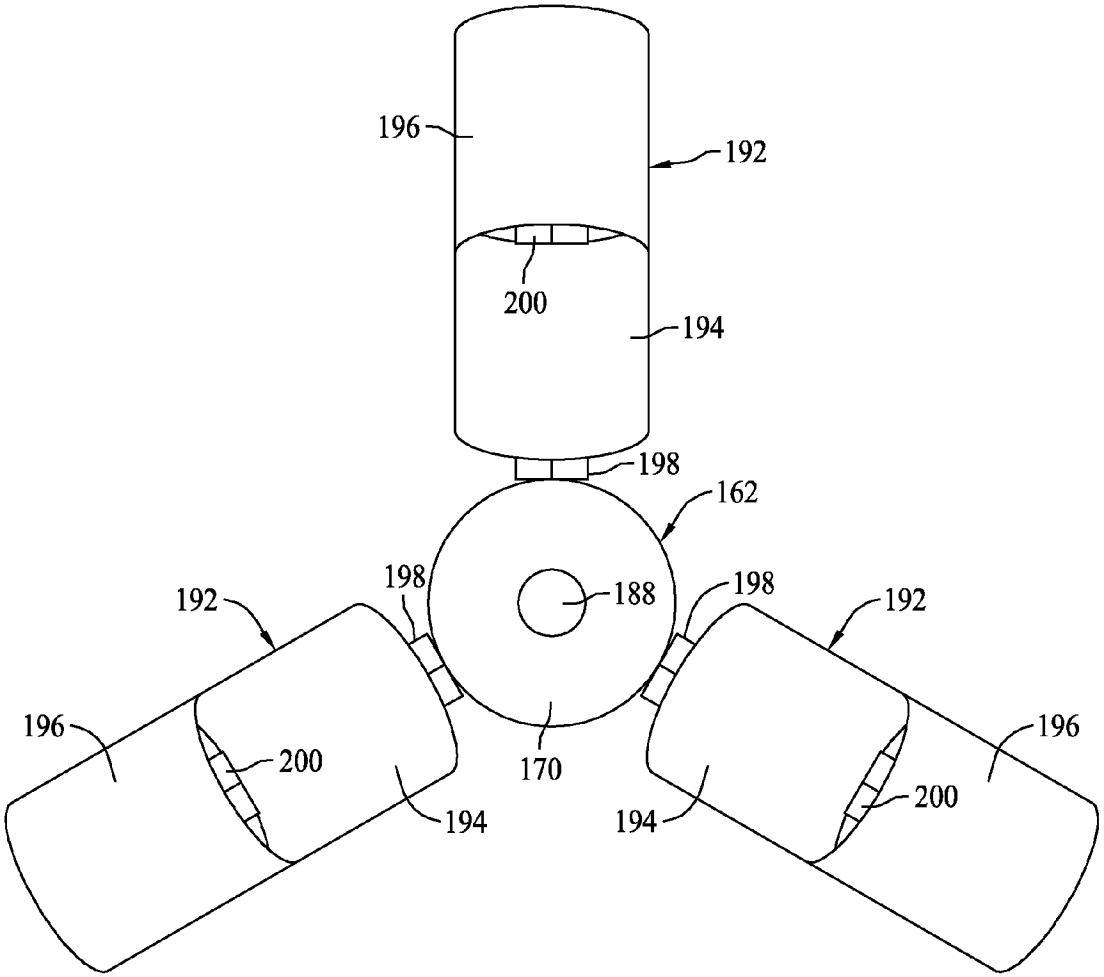
FIG. 19 is an illustration of a top plan view of the targeting control apparatus with the flotation device deployed.
Figure 20:
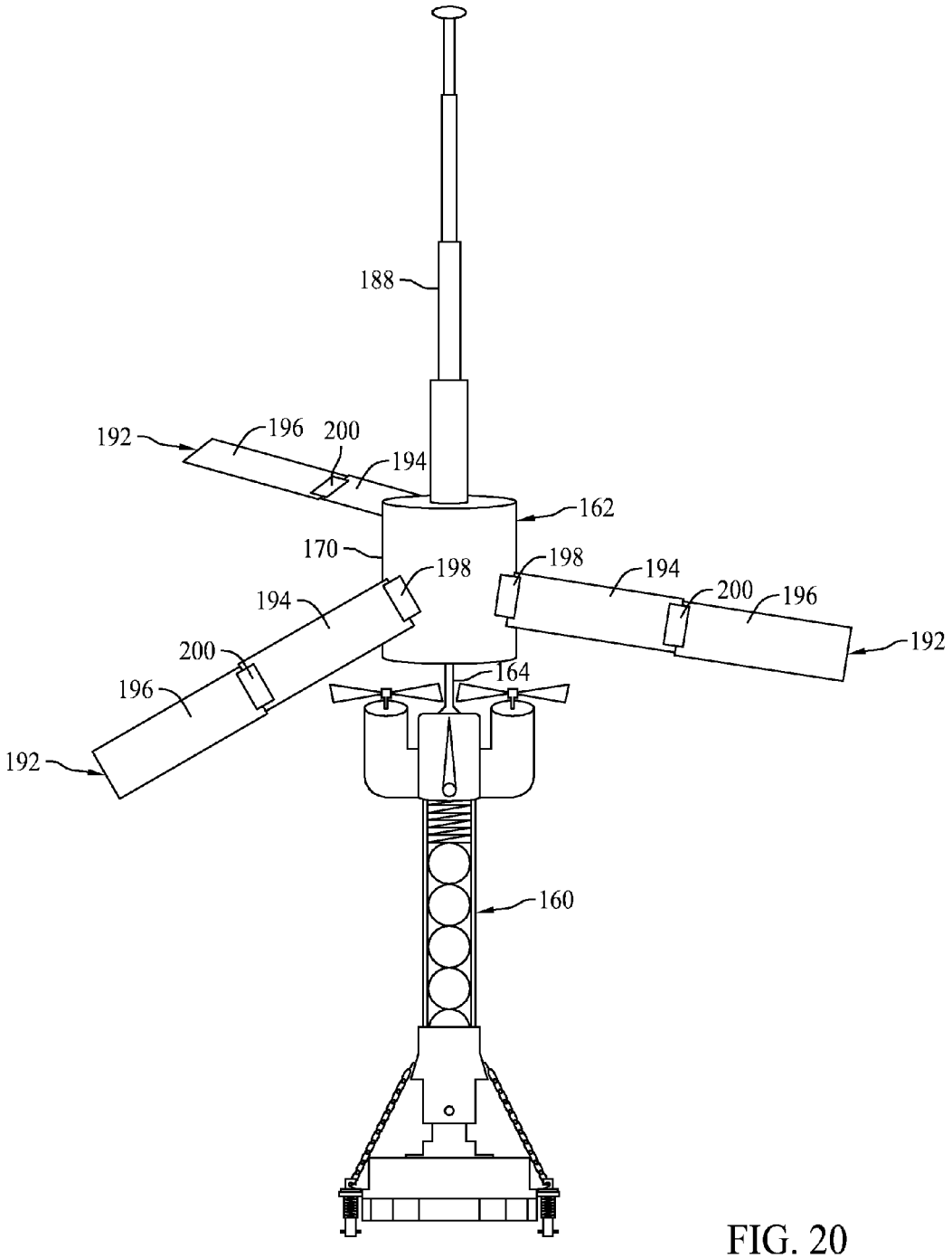
FIG. 20 is a perspective view of the targeting control apparatus with the flotation device deployed and suspending a miniature torpedo.

Flotation devices 192 are provided on the exterior of the targeting control apparatus housing 170. In the example of the apparatus shown in FIGS. 17, 19 and 20, there are three floatation devices 192. Each of the flotation devices 192 are constructed and function in the same manner and therefore only one flotation device will be described. Each flotation device 192 is comprised of a pair of arc shaped arms 194, 196 as shown in FIGS. 17 and 18. Each of the arms is constructed of a buoyant material, thereby providing the housing 170 with buoyancy. Referring to FIG. 18, a first of the pair of arms 194 is connected to the exterior of the housing 170 by a first pivot connection 198. The second arm 196 is connected to the first arm 194 by a second pivot connection 200. In the undeployed positions of the arms 194, 196 the arms overlap each other and lay across a portion of the cylindrical exterior surface of the housing 170. This is represented in FIGS. 15-17. On deployment of the arms 194, 196, the first arm 194 pivots about the first pivot connection 198 away from the exterior of the housing 170 while the second arm 196 pivots about the second pivot connection 200 away from the first arm 194. These movements of the arms are represented in FIG. 18 which shows one of the flotation devices 192 in its deployed position relative to the targeting control apparatus housing 170. FIGS. 19 and 20 show views of all three of the flotation devices 192 in their deployed positions relative to the targeting control apparatus housing 170.

As with the previously described embodiments of the torpedo, the miniature torpedo 160 and attached targeting control apparatus 162 are designed to be carried by an unmanned aerial vehicle (UVA) to the general geographic area of a target ship. The torpedo 160 and targeting control apparatus 162 may be enclosed in a releasable shell when being transported by the UVA. The UVA would then launch or deploy the shell containing the torpedo 160 and targeting control apparatus 162 in the general area of the detected target. A small parachute attached to the shell would allow it to slowly fall from the UVA to the water surface. Once in the water, the shell would separate from the miniature torpedo 160 and attached targeting control apparatus 162. The control unit 182 would then control the flotation devices 192 to be deployed. The deployed flotation devices would support the targeting control apparatus 162 on the surface of the water with the targeting control apparatus 162 suspending the miniature torpedo 160 below the water surface. The control unit 182 would then control the targeting control apparatus 162 to locate the target and then release the torpedo and control the torpedo 160 to travel to the target.

Figure 21:
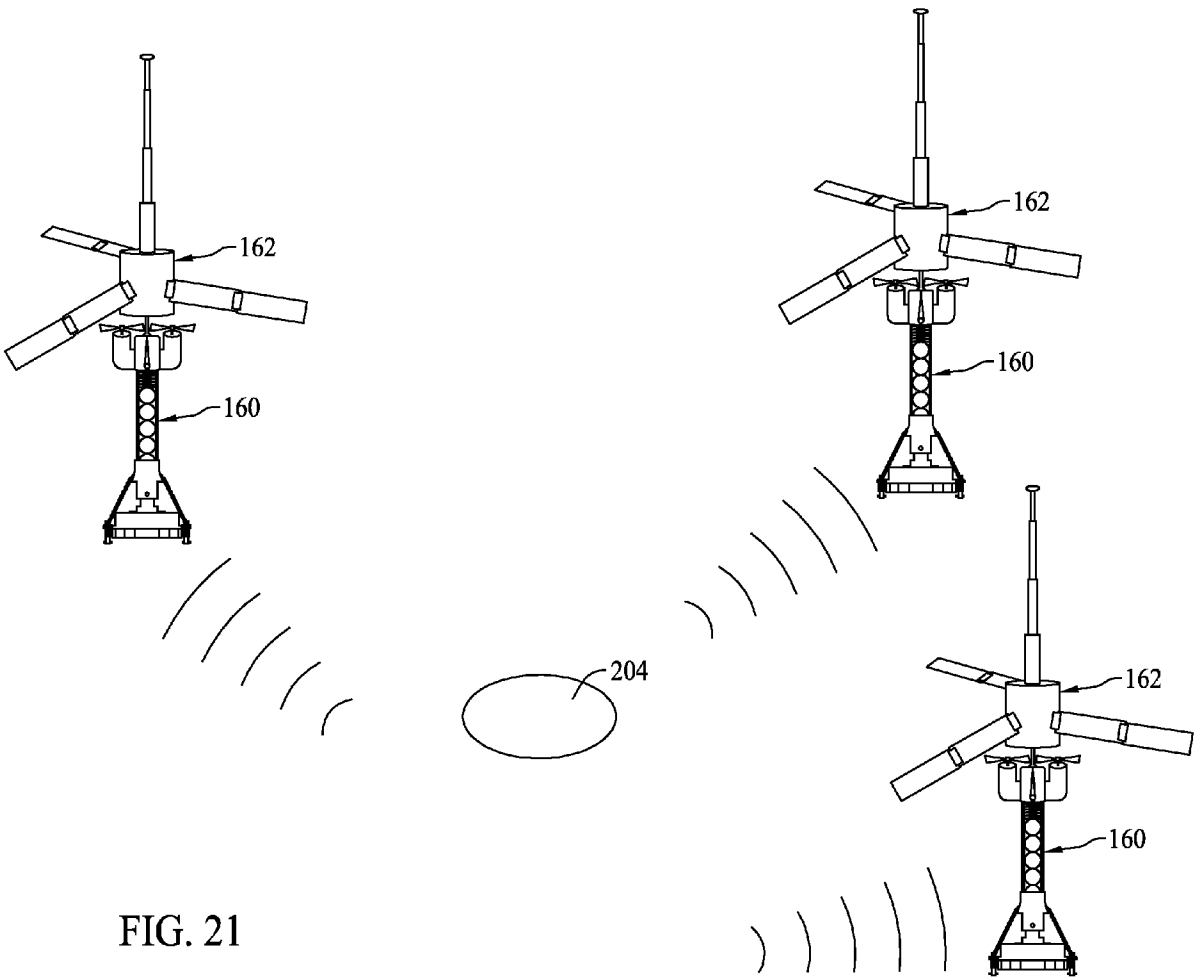
FIG. 21 is a schematic representation of a plurality of the targeting control apparatus and suspended miniature torpedos triangulating target location information.

FIG. 21 is a representation of a plurality of miniature torpedoes 160 and their attached targeting control apparatus 162 that have been delivered to the water surface at a plurality of positions around a target 204. When deployed the antenna 188 of each targeting control apparatus 162 is extended and transmits signals that are received by the antenna of the other targeting control apparatus and/or by a central command to coordinate an attack by the plurality of miniature torpedos 160 on the target 204. By deploying a plurality of miniature torpedoes 160 and their attached targeting control apparatus 162, the targeting control apparatus can track the movements of the target 204 by triangulation. Each of the targeting control apparatus 162 can then release their attached miniature torpedo 160 and control the movements of the torpedo through signals communicated to the torpedo through the wiring 66 connected between the targeting control apparatus 162 and the torpedo 160. The targeting control apparatus 162 can continuously track the target 204 by triangulation while sending signals to their respective miniature torpedoes 160 that direct the torpedos to the target for a coordinated attack.

As various modifications could be made in the construction of the apparatus herein described and illustrated and its method of use without departing from the scope of the invention, it is intended that all matter contained in the foregoing description or shown in the accompanying drawings shall be interpreted as illustrative rather than limiting. Thus, the breadth and scope of the present invention should not be limited by any of the above described exemplary embodiments, but should be defined only in accordance with the following claims appended hereto and their equivalents.

The invention claimed is:

1. A miniature torpedo targeting control apparatus comprising:

a buoyant housing;

a miniature torpedo releasably attached to the buoyant housing;

a control unit in the buoyant housing, the control unit being operable to control releasing the miniature torpedo from the buoyant housing in response to the control unit receiving a release signal;

a communication device on the buoyant housing, the communication device being operable to communicate the release signal to the control unit in response to the communication device receiving a control signal transmitted from a separate source;

a flotation device on the buoyant housing, the flotation device being operable to deploy from the buoyant housing when the buoyant housing is in water and provide the buoyancy to the buoyant housing; and, the flotation device when deployed being operable to support the buoyant housing on a surface of the water enabling the communication device to transmit communication signals over the surface of the water and to receive communication signals over the surface of the water.

2. The apparatus of claim 1, further comprising:

the buoyant housing suspending the miniature torpedo releasably attached to the buoyant housing below the buoyant housing when the buoyant housing and miniature torpedo are in water.

3. The apparatus of claim 1, further comprising:

a length of wire having opposite first and second ends, the wire first end being operatively connected to the control unit and the wire second end being operatively connected to the miniature torpedo.

4. The apparatus of claim 3, further comprising:

a tubular sleeve projecting from the miniature torpedo; and, the lengths of wire extending through the tubular sleeve.

5. The apparatus of claim 4, further comprising:

the tubular sleeve be releasably attached to the buoyant housing and thereby the torpedo is releasably attached to the buoyant housing.

6. The apparatus of claim 5, further comprising:

a catch mechanism on the bottom of the buoyant housing, the catch mechanism being operable to relesably attach the miniature torpedo to the buoyant housing with the miniature torpedo suspended from the bottom of the buoyant housing.

7. The apparatus of claim 1, further comprising:

the communication device including a transceiver and an antenna operatively communicating with the transceiver.

8. The apparatus of claim 7, further comprising:

the antenna being a telescoping antenna.

9. The apparatus of claim 1, further comprising:

the buoyant housing being one of a plurality of buoyant housings;

each buoyant housing having a miniature torpedo releasably attached to the buoyant housing;

each buoyant housing having a control unit in the buoyant housing, the control unit being operable to control releasing the miniature torpedo from the buoyant housing in response to the control unit receiving a release signal; and, each buoyant housing having a communication device on the buoyant housing, the communication device being operable to communicate a release signal to the control unit in response to the communication device receiving a control signal transmitted from a separate source.

10. A miniature torpedo targeting control apparatus comprising:

a miniature torpedo;

a housing;

a catch mechanism on the housing, the catch mechanism being operable to attach to and hold the miniature torpedo to the housing and to detach from and release the miniature torpedo from the housing;

a flotation device on the housing, the flotation device being operable to support the housing on a surface of water with the miniature torpedo being attached to the housing by the catch mechanism and suspended from the housing in the water;

a control unit in the housing, the control unit being operable to control the catch mechanism to attach to and hold the miniature torpedo and to detach from the miniature torpedo in response to a release signal received by the control unit; and, a communication device in the housing, the communication device being operable to communicate the release signal to the control unit in response to the communication device receiving a control signal transmitted from a separate source.

11. The apparatus of claim 10, further comprising:

a length of wire having opposite first and second ends, the wire first end being operatively connected to the control unit and the wire second end being operatively connected to the miniature torpedo.

12. The apparatus of claim 11, further comprising:

a tubular sleeve projecting from the miniature torpedo; and, the lengths of wire extending through the tubular sleeve.

13. The apparatus of claim 12, further comprising:

the tubular sleeve being releasably attached to the housing and thereby the torpedo being releasably attached to the housing.

14. The apparatus of claim 10, further comprising:

the communication device including a transceiver and an antenna operatively communicating with the transmitter.

15. The apparatus of claim 14, further comprising:

the antenna being a telescoping antenna.

16. The apparatus of claim 11, further comprising:

the miniature torpedo targeting control apparatus being one of a plurality of miniature torpedo control apparatus.

17. A method of controlling targeting of a miniature torpedo comprising:

releasably attaching a miniature torpedo to a buoyant housing containing a control unit that is operable to control releasing the miniature torpedo from the buoyant housing and directing the miniature torpedo to a target;

delivering the buoyant housing and attached miniature torpedo to a location on water where the buoyant housing suspends the miniature torpedo;

deploying a flotation device from the buoyant housing with the buoyant housing in the water, the flotation device providing buoyancy to the buoyant housing and supporting the buoyant housing on a surface of the water enabling a communication device in the buoyant housing to transmit communication signals over the surface of the water and to receive communication signals over the surface of the water; and, controlling the control unit to release the miniature torpedo and direct the miniature torpedo toward a target in response to the communication device receiving a communication signal over the surface of the water.

18. The method of claim 17, further comprising:

providing a transceiver in the buoyant housing and transmitting signals indicative of the location of the miniature torpedo from the transceiver and receiving signals indicative of a location of the target by the transceiver.

19. The method of claim 17, further comprising:

delivering a plurality of buoyant housings and attached miniature torpedoes to a plurality of water locations.

* * * * *